US005979591A

United States Patent [19]

Harrison

[11] Patent Number: 5,979,591

[45] Date of Patent: Nov. 9, 1999

[54] COLLAPSIBLE PORTABLE SPEAKER ENCLOSURE

[76] Inventor: James B. Harrison, P.O. Box 2561, Syracuse, N.Y. 13220

[21] Appl. No.: 09/167,210

[22] Filed: Oct. 6, 1998

[51] Int. Cl.[6] ..... A47B 81/06

[52] U.S. Cl. ..... 181/199; 181/151

[58] Field of Search ..... 181/146, 151, 181/166, 199, 144, 148

[56] References Cited

U.S. PATENT DOCUMENTS

| | | | |
|---|---|---|---|
| D. 302,903 | 8/1989 | Johnston . | |
| D. 304,881 | 12/1989 | Zinbarg et al. . | |
| 745,029 | 11/1903 | De Vineau . | |
| 2,795,258 | 6/1957 | Berry et al. . | |
| 2,958,769 | 11/1960 | Bounds . | |
| 3,621,155 | 11/1971 | Pruitt . | |
| 3,824,343 | 7/1974 | Dahlquist . | |
| 3,866,712 | 2/1975 | Carruthers . | |
| 3,872,235 | 3/1975 | Manly, Jr. . | |
| 4,101,736 | 7/1978 | Czerrwinski | 181/151 |
| 4,168,762 | 9/1979 | Griffin, Jr. . | |
| 5,218,176 | 6/1993 | Meyer, Jr. | 181/199 |

*Primary Examiner*—Khanh Dang
*Attorney, Agent, or Firm*—Trapani & Molldrem

[57] ABSTRACT

A portable loudspeaker enclosure is made of a collapsible shell of a fabric material, e.g., canvas, having top, bottom, left, right, and back walls. These walls each are each formed of a sandwich of fabric layers and an acoustic insulation layer, such as foamed plastic or glass fiber, the insulation layer being disposed to the inside of the shell. The fabric at each wall forms a pouch co-extensive with the wall. A rigid speaker frame serves as a front wall for the enclosure and is fitted into the front of the enclosure. The frame extends within the shell towards the back wall to a point behind the loudspeaker, i.e., about one-third of the front-to-back dimension. For each wall there is a rigid batt or insert that is dimensioned to fit removably into the pouch. The batts create a rigid cavity behind the loudspeaker. The portable enclosure can have a front cover that removably covers the front wall of the enclosure, i.e., for storage and transit. The cover includes space for carrying the batts when they are removed from their pouches.

8 Claims, 6 Drawing Sheets

COLLAPSIBLE PORTABLE SPEAKER ENCLOSURE

BACKGROUND OF THE INVENTION

This invention relates to loudspeakers, and is more particularly directed to loudspeaker enclosures that are collapsible to facilitate take down and set up, and which are also light-weight. The invention is specifically concerned with a portable speaker enclosure for performance or similar use that can replace bulky, and heavy rigid speaker enclosures.

Loudspeaker assemblies require an enclosure or chamber, which may or may not also include a vent or port, for the purpose of projecting the sound that is generated in the speaker. At the front of the enclosure is a front baffle, i.e., a board or plate on which the speaker or speakers are mounted. The baffle also has openings through which the sound is projected to radiate toward the audience. Typically, the enclosure has a large cabinet, with an interior volume of specific number of cubic inches so as to match the speaker's frequency response. The cabinet is usually very heavy, usually wood or equivalent, so that the cabinet does not vibrate or create undesirable buzzing or other noises. The inside of the cabinet is usually lined with plastic foam, fiber glass batt, or another acoustic insulating material. This absorbs unwanted vibrations, especially at higher frequencies, which can also cause undesirable distortion. A typical portable loudspeaker assembly with a rigid enclosure is discussed in U.S. Pat. No. 4,168,762.

Folding cabinets for speaker enclosures have been proposed, but these have not been satisfactory. The folding cabinets generally have hinged sides to permit them being set up and taken down so that they occupy less space during transport. However, these folding speaker enclosures are every bit as heavy as a conventional speaker enclosure and are equally as cumbersome once set up for use. Also, the hinged sides tend to rattle and produce unwanted noises during use, decreasing suitability of the speaker assembly for musical performers.

Ideally, a soft-sided, portable speaker enclosure would have the advantages of low weight and collapsibility, but would not have the disadvantages of the rigid enclosures mentioned above. However, because of the need for rigidity of the walls that define the acoustic chamber behind the speaker, no suitable soft-sided enclosure has been proposed to date.

OBJECTS AND SUMMARY OF THE INVENTION

Accordingly, it is an object of the present invention to provide a collapsible, portable speaker enclosure that avoids the drawbacks of the prior art.

It is another object to provide a speaker enclosure that can be collapsed down to about one third of its opened size, and which is relatively light weight.

It is a more specific object to provide a collapsible speaker enclosure whose sides are made rigid, but does not suffer from unwanted vibrations or distortion that plague other portable speaker enclosures.

In accordance with one aspect of the present invention, a portable loudspeaker enclosure is made of a collapsible shell of a fabric material, e.g., a heavy duty weather resistant canvas, having a top wall, a bottom wall, a left wall, a right wall, and a back wall. These five walls each are each formed of a sandwich of fabric layers and an acoustic insulation layer, with the insulation layer being disposed to the inside of the shell. The fabric layers at each wall form an associated pouch that is substantially co-extensive with the wall. A rigid speaker frame serves as a front wall for the enclosure and is fitted into the front of the enclosure. The frame has one or more openings into which a loudspeaker is mounted, and extends within the shell towards the back wall to a point behind the loudspeaker. This is typically no more than about one-third of the front-to-back dimension, but is sufficient to protect the diaphragm, voice coil, and permanent magnet of the speaker. For each of the five walls there is a rigid batt or insert that is dimensioned to fit removably into the pouch of the respective wall. The batts can be made of a suitable rigid material, such as plastic or plywood, and make the shell rigid to create a rigid cavity behind the loudspeaker. The combination of fabric sides sewn together, plus the batts that are held in the pouches or pockets, avoid any problems of buzz or resonating that can occur in other portable speaker enclosures. There can be Velcro closures on the pouches to retain the batts or inserts.

The portable enclosure can have a front cover dimensioned so that it removably covers the front wall of the enclosure, i.e., for storage and transit. The cover includes space for carrying the batts when they are removed from their pouches. The cover is preferably made of the same canvas material. A zipper can be used to attach the cover to the shell.

A stand mount can be attached through the bottom wall to the front frame, so that the enclosure can be elevated onto a stand.

When all the batts are in place in the pouches, the enclosure forms a rigid rectangular cavity behind the speaker. If only the top and bottom wall batts are used, then the enclosure forms a wedge shape, and can be used as a floor monitor. When the speaker is not in use, the batts are removed from the pouches and are stored in the cover. The cover, containing the batts, is zipped to the front of the shell, and the cavity behind the speaker frame collapses, so that the enclosure, when folded down, is about one-third the volume that it occupies when set up. The enclosure is much lighter than the standard rigid enclosures of the same physical size. This makes it much easier to transport and set up the sound equipment than was previously possible.

The above and many other objects, features, and advantages of this invention will be more fully appreciated from the ensuing description of a preferred embodiment, which is to be read in conjunction with the accompanying Drawing.

DETAILED DESCRIPTION OF THE PREFERRED EMBODIMENT

Figure 1:
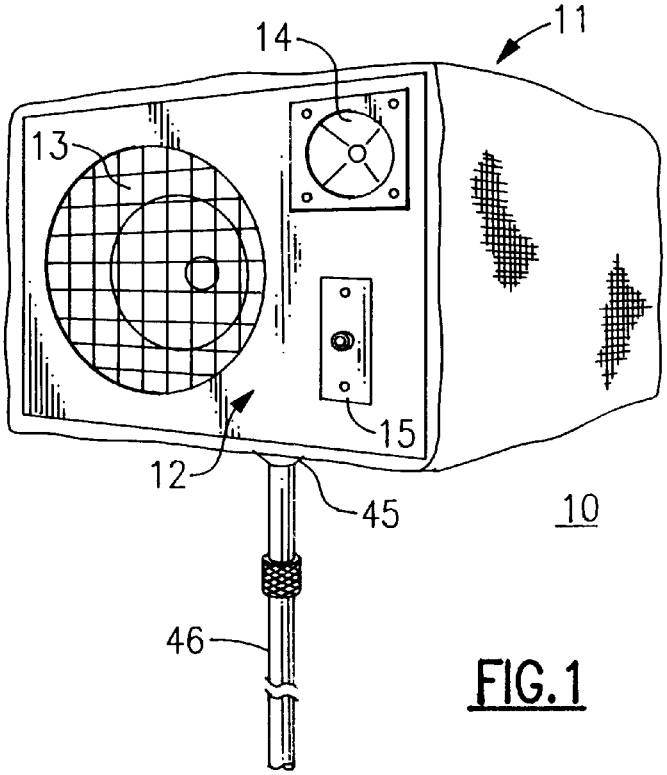
FIG. 1 is a perspective view of collapsible speaker enclosure assembly, as set up for use, according to an embodiment of the present invention.

With reference now to the Drawing, FIG. 1 shows an embodiment of the speaker enclosure 10 of this invention, here in an expanded configuration for use with an amplifier, for example, at an outdoor musical performance. The enclosure has a fabric shell 11 generally in the form of a parallelepiped or rectangular shape, with a front baffle 12 forming a front wall of the enclosure. The front baffle is of a solid, rigid material, which can be plywood, plastic sheet, or composite material. Here there is a low frequency speaker 13 and a high frequency speaker 14 mounted on the baffle. A cord socket or jack 15 is also mounted on the front baffle to receive a cord (not shown) that connects to an amplifier.

Figure 2:
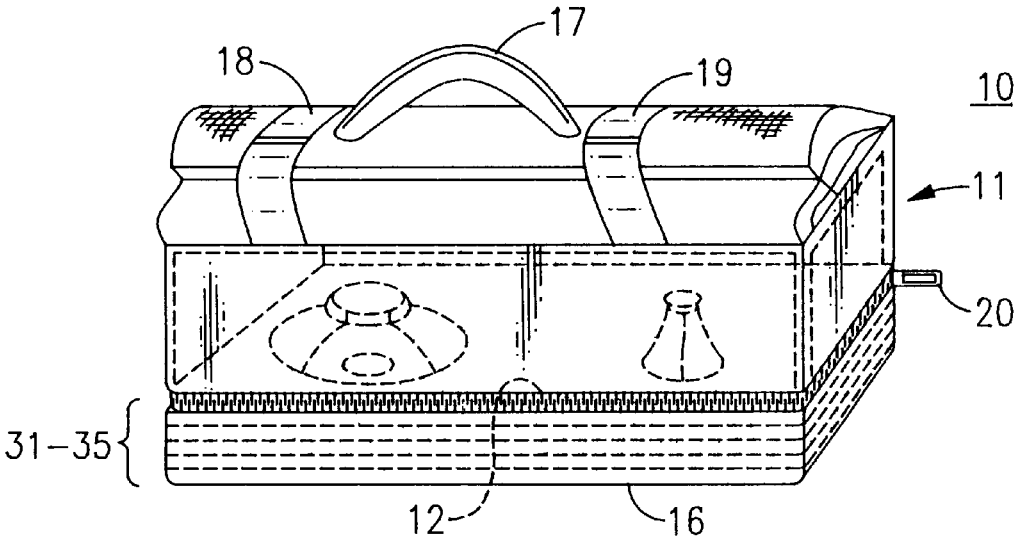
FIG. 2 is a perspective view of the enclosure assembly of this embodiment shown in its collapsed condition for transport or storage.

The enclosure 10 is shown in FIG. 2 in its collapsed or folded-down configuration for storage or transport. A removable fabric front cover 16 is shown removably attached over the front of the front baffle 12. The cover 16 also provides space for storing batts or inserts that fit into wall pockets or pouches, as will be described shortly. The back wall of the enclosure has a carrying handle 17 as well as a pair of Velcro-closure cinches 18 and 19. In this embodiment a zipper closure 20 encircles the shell 11 and removably attaches the cover 16 to the shell 11. The front cover 16 is unzipped for removal, as shown in FIG. 3.

Figure 3:
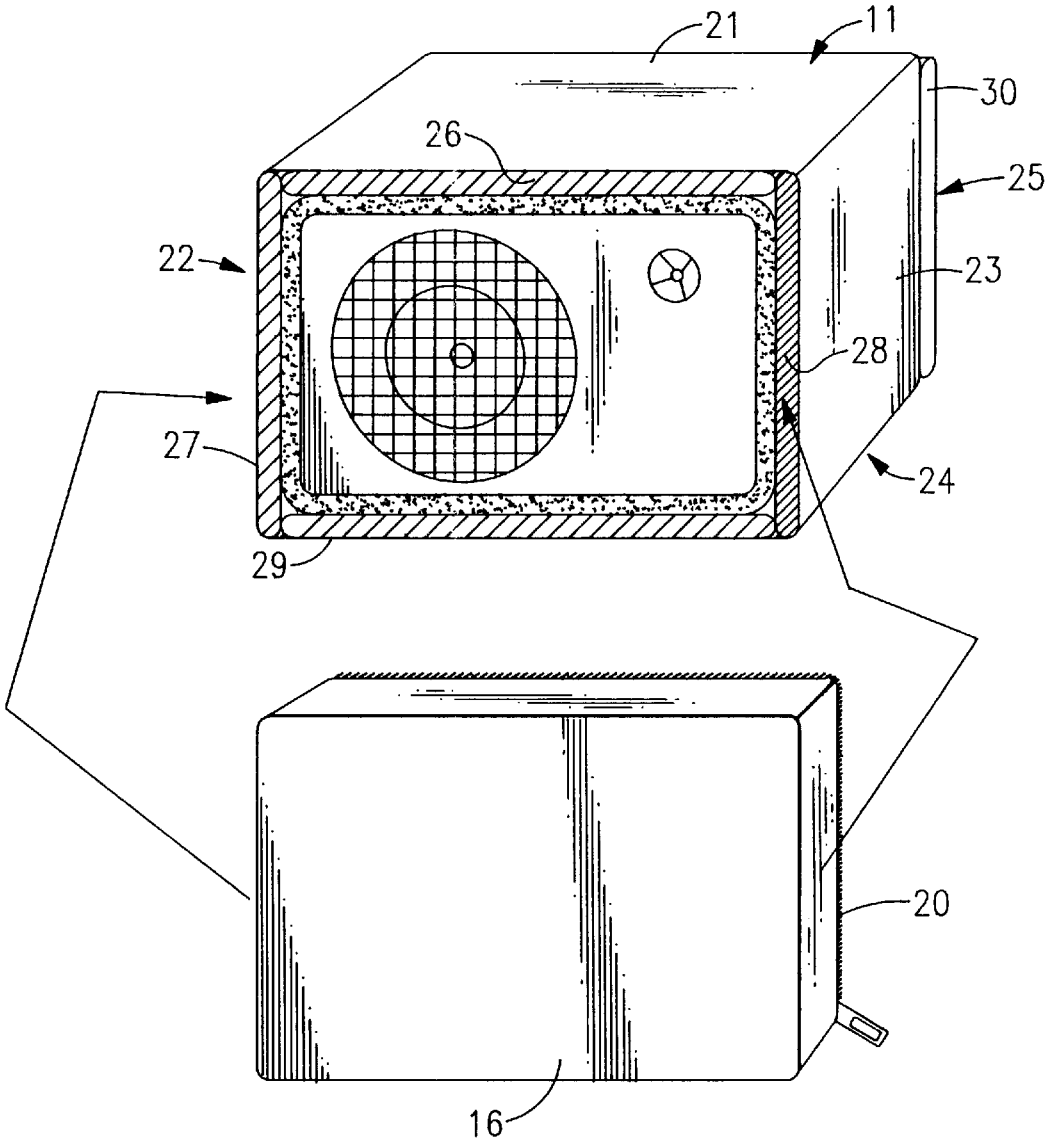
FIG. 3 is a front perspective view of the enclosure of this embodiment shown with the cover removed therefrom.
Figure 4:
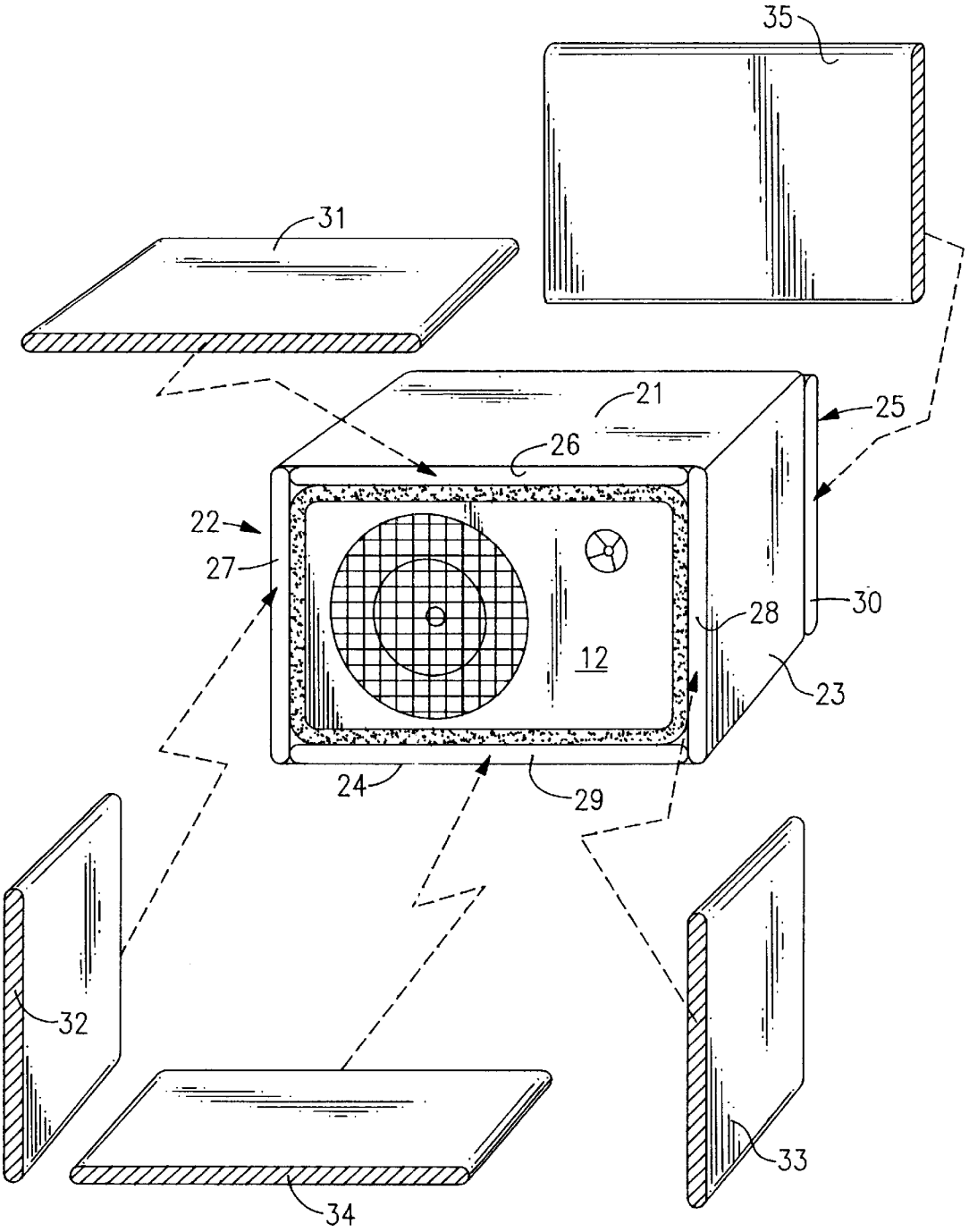
FIG. 4 is a front perspective assembly view of this embodiment.

The fabric shell 11 has a top wall 21, a left wall 22, a right wall 23, a bottom wall 24, and a back wall 25, as shown in FIG. 3, with each wall being sewn of two or more layers so that the walls define respective pockets or pouches. Here there is a top wall pouch 26, a left wall pouch 27, a right wall pouch 28, a bottom wall pouch 29 and a back wall pouch 30, each of which receives a removable panel or batt of plywood, plastic or other reasonably rigid material. The batts are inserts that are coextensive with the respective wall, so that the walls are each made substantially rigid from edge to edge. As shown in FIG. 4, there is a top batt 31, a left side batt 32, a right side batt 33, a bottom batt 34, and a back batt 35 to fit the pouches 26 to 30, respectively.

Figure 5:
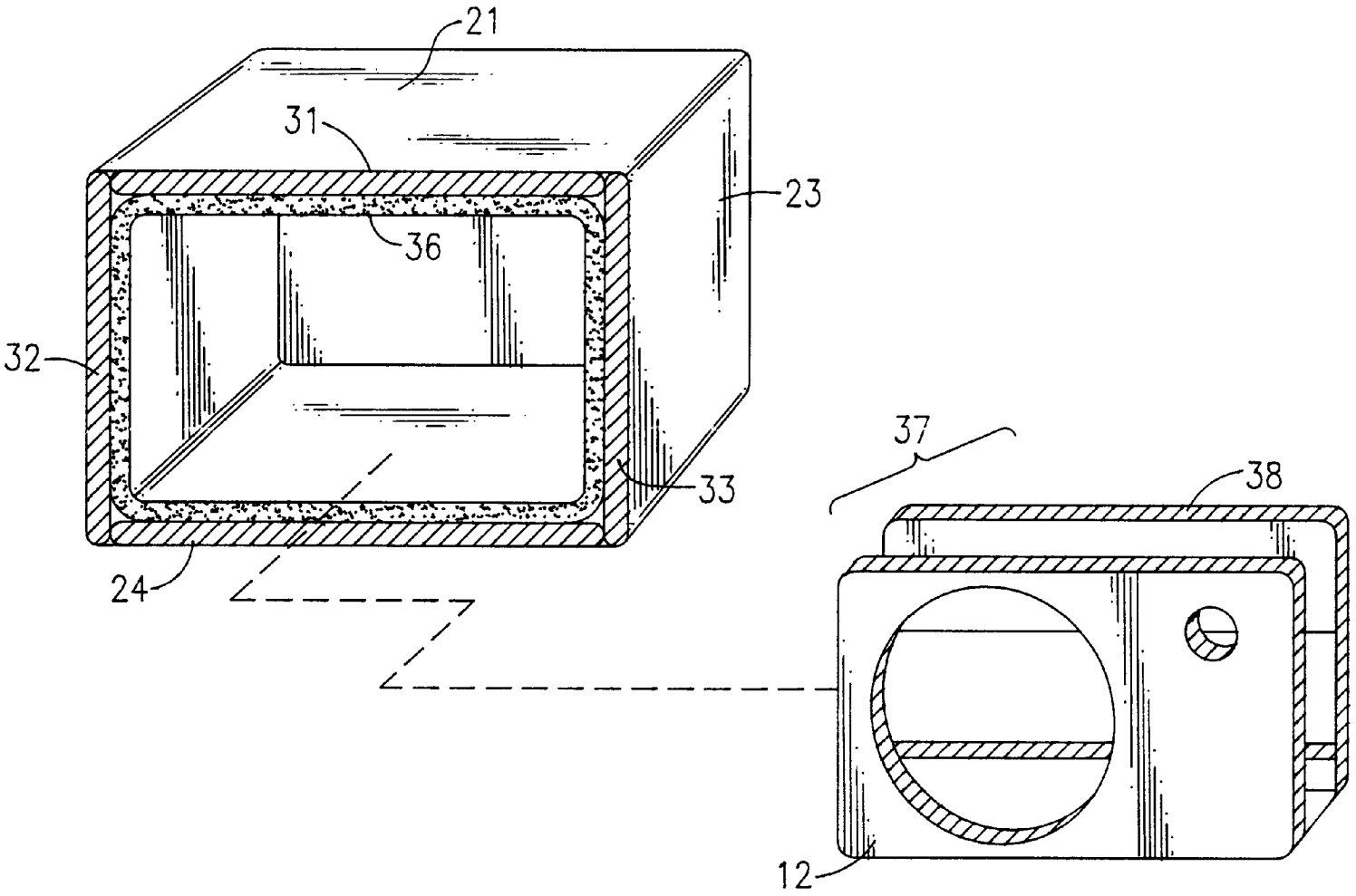
FIG. 5 is an assembly view showing the speaker frame and shell.
Figure 6:
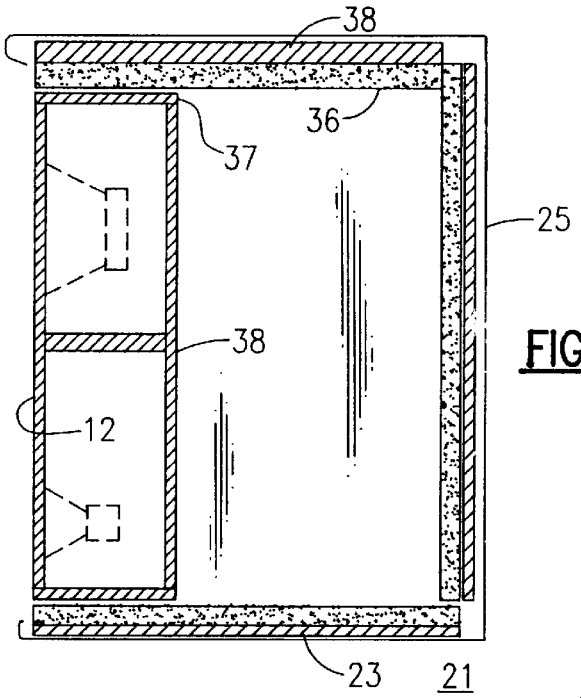
FIG. 6 is a cross sectional view of this embodiment.
Figure 7:
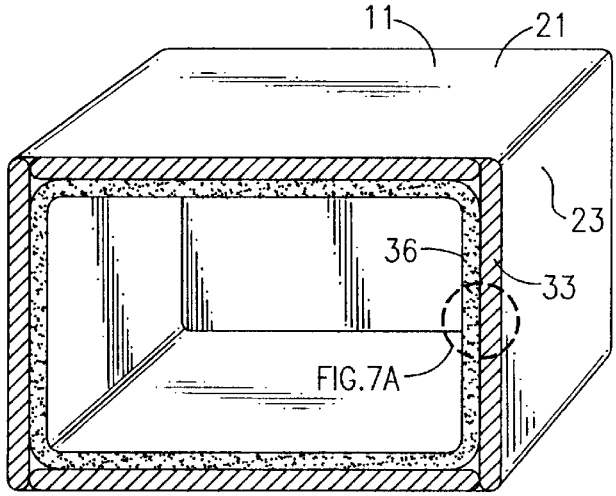
FIG. 7 is a front view of the shell of this embodiment.
Figure 7A:
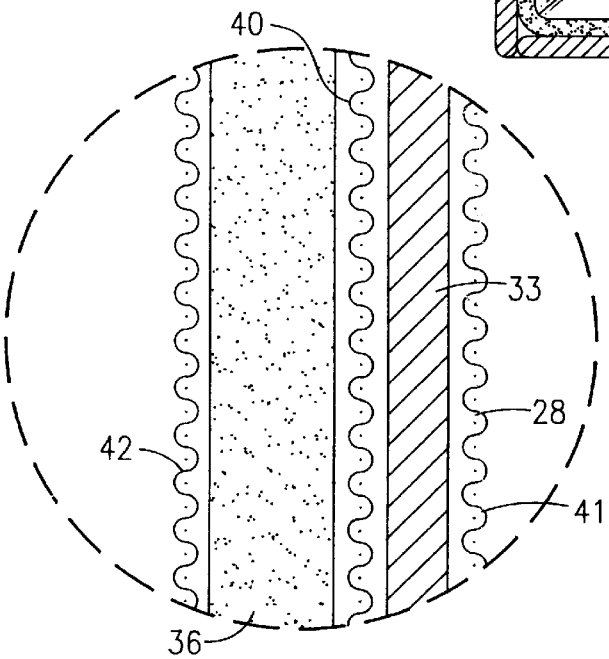
FIG. 7A is an enlargement of a portion thereof.

As shown in FIG. 5, the shell 11 has a foamed plastic liner 36 which serves as an acoustic insulation. The lining 36 is situated on the interior of each of the walls 21 to 25, and may be bare or may be covered with an acoustically transparent material, as desired. A front frame 37 is dimensioned to fit within the front opening of the shell 11, and is formed of the front baffle or wall 12 and a rear frame member 38, as well as such additional struts and supports as are needed. As shown in FIG. 6, the frame 37 is situated into the front of the shell and extends rearwardly about a third of the distance towards the back wall 25. The rear frame member 38 should be positioned just back of the voice coils and permanent magnets of the speakers 13, 14 to provide some protection. While not shown in detail here, there are screws or other suitable fasteners through the shell 11 to fasten the frame 37 into the front of the shell. As shown in FIG. 7 and in more detail in FIG. 7A, the fabric walls of the shell are of a multiple layers, here as illustrated with reference to the right side wall 23, shown with the batt 33 in the associated pocket or pouch 28. Here there is a canvas layer 40 and an outer canvas layer 41 which together define the associated pouch 28 between them. The insulation layer 36, which here is a foamed plastic, but could instead be glass fibers or other equivalent material, is situated on the inner side of the canvas layer 40. An inner fabric liner 42, e.g., a mesh, can be disposed on the inner side of the insulating layer 36, with the layer 36 being sandwiched between the canvas layer 40 and the liner 42. The liner 42, which is optional, can be any suitable material that is acoustically transparent, at least for a given band of audio frequencies.

Figure 8:
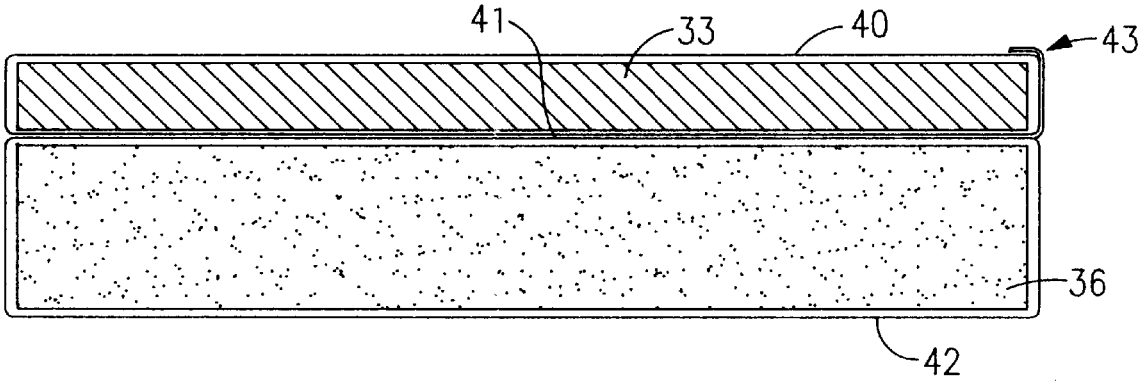
Fig. 8 is a cross section of a wall of this embodiment.

FIG. 8 illustrates a Velcro closure 43 for the pouch 28, which holds the batt 33 snugly in place, but opens easily to permit the batt 33 to be removed for takedown of the enclosure. Wall 23 is shown here as typical, but all the five walls would be of similar construction.

Figure 9:
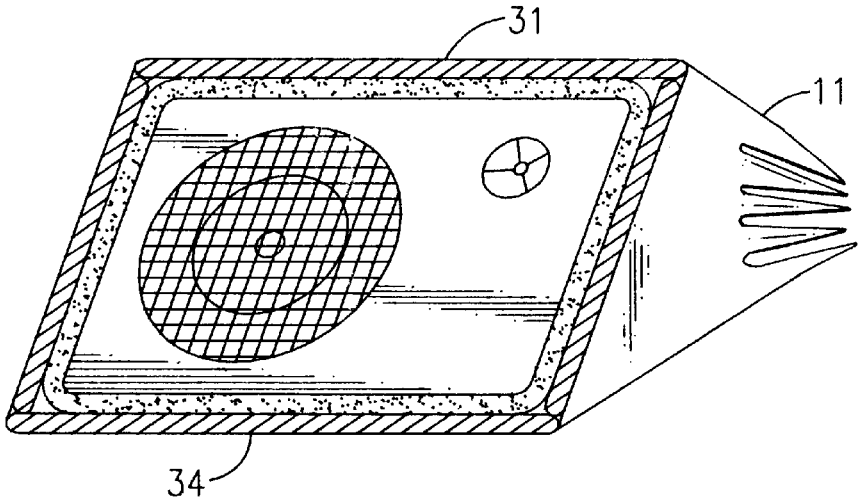
FIG. 9 illustrates the enclosure of this embodiment configured as a floor monitor.

While the enclosure has been shown with five batts 31 to 35 for rigidifying the five walls 21 to 25, the enclosure could be configured with fewer batts in place for some purposes. For example, FIG. 9 illustrates the same enclosure 10, but with only the top batt 31 and bottom batt 34 in place in the respective pockets 26, 29, with the side pouches 27, 28 and the back pouch 30 being left empty. In this case, the enclosure takes on a wedge shape, and can be used in this form as a stage monitor or floor monitor.

Returning to FIG. 1, the enclosure is also provided with a stand mount 45, or other suitable hardware for securing the enclosure 10 to a stand 46 or post. In this case the stand mount 45 is secured by wood screws or other suitable fasteners through the bottom wall 24 into the lower part of the front frame 37.

The canvas used in the fabric walls can be a durable canvas or canvas-like material, for example nylon based, and can rugged and be waterproof for outdoor use. With the batts or inserts removed, the enclosure collapses to about one third of its expanded size. The batts are then stored within the cover 16, which is zipped onto the front of the enclosure, which serves as the bottom for handling, travel and storage. On the other hand, the speaker enclosures are free of rattle and unwanted vibration.

The size and shape of the enclosure depends on the power and frequency range of the associated speakers, and so a great deal of variety is possible beyond what is illustrated for this preferred embodiment. The speakers can also be stacked one above the other, and associated with different sound channels to obtain an optimal acoustic effect. Also, terms of orientation, such as top, bottom, side, and back, have been used in this specification with reference to the Drawing for the convenience of the reader, and it should be understood that the enclosure could be placed in other orientations.

While the invention has been described with reference to specific preferred embodiments, the invention is certainly not limited to those precise embodiments. Rather, many modifications and variations will become apparent to persons of skill in the art without departure from the scope and spirit of this invention, as defined in the appended claims.

I claim:

1. A portable loudspeaker enclosure comprising a collapsible shell having a plurality of walls; said walls each being formed of a sandwich of fabric layers and an acoustic insulation layer, with the insulation layer being disposed to the inside of the shell, and the fabric layers defining a pouch that is substantially co-extensive with the associated wall;

a rigid speaker frame forming a front wall of said enclosure and fitted into said enclosure, the frame having one or more openings into which a loudspeaker is mounted, said frame extending within said shell rearwardly to a point behind said loudspeaker;

a plurality of rigid batts dimensioned to fit removably into the pouches of said walls, respectively, for rigidifying said shell to create a rigid cavity behind said loudspeaker.

2. A portable loudspeaker enclosure according to claim 1 wherein said plurality of walls includes a top wall, a bottom wall, a left wall, a right wall, and a back wall, and said batts are respectively dimensioned to fit removably into the pouches of said top, bottom, left, right, and back walls, respectively.

3. A portable loudspeaker enclosure according to claim 2 wherein said frame extends about one-third of the way towards said back wall.

4. A portable loudspeaker enclosure according to claim 1 further comprising a front cover dimensioned for removably covering the front wall of said enclosure, and including means for carrying said batts when removed from their respective pouches.

5. A portable loudspeaker enclosure according to claim 4 wherein said cover is formed of fabric material and includes zipper means for removably attaching to said shell.

6. A portable loudspeaker enclosure according to claim 1 further comprising a stand mount attached through said bottom wall to said frame.

7. A portable loudspeaker enclosure according to claim 1 wherein said pouches comprise Velcro closures to retain the associated batts therein.

8. A portable loudspeaker enclosure according to claim 1 wherein said fabric is a canvas material.

* * * * *